US008854187B2

(12) United States Patent
Motta

(10) Patent No.: US 8,854,187 B2
(45) Date of Patent: Oct. 7, 2014

(54) SYSTEM AND METHOD FOR WIRELESS INTERACTIVE SECURITY SERVICES USING A KEY-SWITCH INTERFACE

(75) Inventor: Gilson O. Motta, Lawrenceville, GA (US)

(73) Assignee: Telular Corporation, Chicago, IL (US)

( * ) Notice: Subject to any disclaimer, the term of this patent is extended or adjusted under 35 U.S.C. 154(b) by 1058 days.

(21) Appl. No.: 12/882,426

(22) Filed: Sep. 15, 2010

(65) Prior Publication Data

US 2012/0062359 A1 Mar. 15, 2012

(51) Int. Cl.

| | |
|---|---|
| ***G08B 5/22*** | (2006.01) |
| ***G08B 25/00*** | (2006.01) |
| *G08B 25/10* | (2006.01) |

(52) U.S. Cl.

CPC ..... *G08B 25/008* (2013.01); *G08B 25/10* (2013.01)

USPC ..... 340/6.1; 340/506; 340/540

(58) Field of Classification Search

CPC ..... G08B 13/00; G08B 25/08; G08B 25/10

See application file for complete search history.

(56) References Cited

U.S. PATENT DOCUMENTS

| | | | | |
|---|---|---|---|---|
| 5,463,595 | A * | 10/1995 | Rodhall et al. | 367/93 |
| 6,130,610 | A * | 10/2000 | Schilsky et al. | 340/539.14 |
| 6,414,594 | B1 | 7/2002 | Guerlain | |
| 6,940,397 | B1 * | 9/2005 | Le Mire | 340/426.1 |
| 7,113,090 | B1 | 9/2006 | Saylor et al. | |
| 7,130,609 | B2 | 10/2006 | Cardina et al. | |
| 7,312,709 | B2 | 12/2007 | Kingston | |
| 7,312,712 | B1 | 12/2007 | Worrall | |
| 7,643,823 | B2 | 1/2010 | Shamoon et al. | |
| 7,679,503 | B2 | 3/2010 | Mason et al. | |
| 7,741,969 | B2 | 6/2010 | Linford | |
| 7,746,224 | B2 | 6/2010 | Addy | |
| 7,782,199 | B2 * | 8/2010 | Issokson | 340/541 |
| 2003/0104800 | A1 * | 6/2003 | Zak | 455/404 |
| 2008/0204239 | A1 * | 8/2008 | Marszalek et al. | 340/572.1 |
| 2009/0303066 | A1 | 12/2009 | Lee et al. | |
| 2010/0290386 | A1 * | 11/2010 | Cabral Hinojosa et al. | 370/315 |
| 2011/0175739 | A1 * | 7/2011 | McFeeters | 340/584 |

OTHER PUBLICATIONS

EXELE Information Systems, Inc., EXELE TopView Software Data Sheet, Feb. 2010, v6.7.0.

Liu, Stanley, Ethernet Gives Remove Monitoring and Alarm Solution a Big Advantage, Remote Monitoring and Alarm Solution, Apr. 15, 2008, Moxa, Inc.

Hunteman, William, Automated Information Systems—(AIS) Alarm System, University of California, Los Alamos National Laboratory, 1997.

* cited by examiner

*Primary Examiner* — Brian Zimmerman

*Assistant Examiner* — Sara Samson

(74) *Attorney, Agent, or Firm* — Adam K. Sacharoff; Much Shelist

(57) ABSTRACT

In one aspect of the present invention there is provided an alarm communicator configured to communicate directly with an alarm panel. The alarm panel includes a key-switch input terminal which is in direct communication with a relay switch defined on the alarm communicator. The alarm communicator is capable of sending open or closed signals from the relay switch to the key-switch input terminal in response to receiving a command that was initiated from a remote device.

16 Claims, 4 Drawing Sheets

SYSTEM AND METHOD FOR WIRELESS INTERACTIVE SECURITY SERVICES USING A KEY-SWITCH INTERFACE

FIELD OF THE INVENTION

The present invention relates generally to the field of security systems, and in particular to a system and method for wirelessly interacting with security systems using a key-switch interface.

BACKGROUND OF THE INVENTION

In the security and alarm industry, arming and disarming security systems are typically done on-site at the premises. In most circumstances, a keypad located at the premises will arm/disarm the security system upon receiving a pre-defined security code. In addition to entering a security code, almost all security systems include a key-switch interface. A key-switch interface is an access interface on the security system's alarm panel that connects to a key-switch. The key-switch would typically be mounted by an exit/entrance and which permits the arming/disarming of the security system with the use of a physical key that is inserted into the key-switch and then simply turned.

Lastly, the use of wireless remote devices have become a new a method in which to arm/disarm a security system. For example, U.S. Pat. No. 7,113,090 includes one approach to use a mobile device to access the security system. However, in these other approaches, the security system includes a specific access or interface for communicating with the mobile device. This creates a problem with upgrading existing security systems to allow for a mobile device to access and perform certain activities, such as arming/disarming.

It is therefore one aspect of the present invention to improve upon the prior art by providing a system and method for wirelessly interacting with security systems using a key-switch interface.

SUMMARY OF THE INVENTION

In the present invention there is provided for various embodiments. A first embodiment may include an alarm communication provider adapted to send and receive signals to the alarm communicator and adapted to send and receive signals from a remote device or over the internet from a remote device or computer. The alarm communication provider upon receiving a command from the remote device to arm or disarm the alarm system is capable of creating the control signal and sending the control signal to the alarm communicator. In the second embodiment there is provided an alarm system also having an alarm panel and an alarm communicator. The alarm panel has a key-switch input terminal, and the alarm communicator has a relay switch configured to communicate directly with the key-switch input terminal. The relay switch is adapted to send open or close signals to the key-switch input terminal to disarm or arm the alarm system. The alarm communicator further has a signal receiver to receive a control signal created from a command sent from a remote device instructing the alarm communicator to open or close the relay switch such that the alarm system disarms or arms.

In a third embodiment, the present invention may include an alarm system including an alarm panel, the alarm panel has a key-switch input terminal. The system is improved by having an alarm communicator having a relay switch configured to communicate directly with the key-switch input terminal.

When the alarm communicator receives a control signal created from a command based from a remote device, the alarm communicator is able to arm/disarm the alarm system by opening/closing the relay switch.

In a fourth embodiment, the present invention is directed to an alarm communicator configured to communicate directly with an alarm panel that has a key-switch input terminal. The alarm communicator in this embodiment includes a relay switch in communication with the key-switch input terminal. The relay switch is adapted to send open or closed signals to the key-switch input terminal to disarm or arm the alarm panel.

In a fifth embodiment, the present invention provides a method for arming/disarming an alarm system from a remote device. The alarm system has an alarm panel defined to arm/disarm the alarm system and has at least a key-switch input terminal. The method has the following steps. First, providing an alarm communicator with a relay switch and connecting the relay switch to the key-switch input terminal, such that when the relay switch opens or closes, a signal is sent to the key-switch input terminal to disarm or arm the alarm system. Second, sending a command for the arming/disarming of the alarm system to the alarm communicator, wherein the command is based from instructions by a remote device. Third, setting the relay switch to open or close in accordance with the command based from the remote device.

Further features as well as the structure and operation of various embodiments are described in detail below with reference to the accompanying drawings. In the drawings, like reference numbers indicate identical or functionally similar elements.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
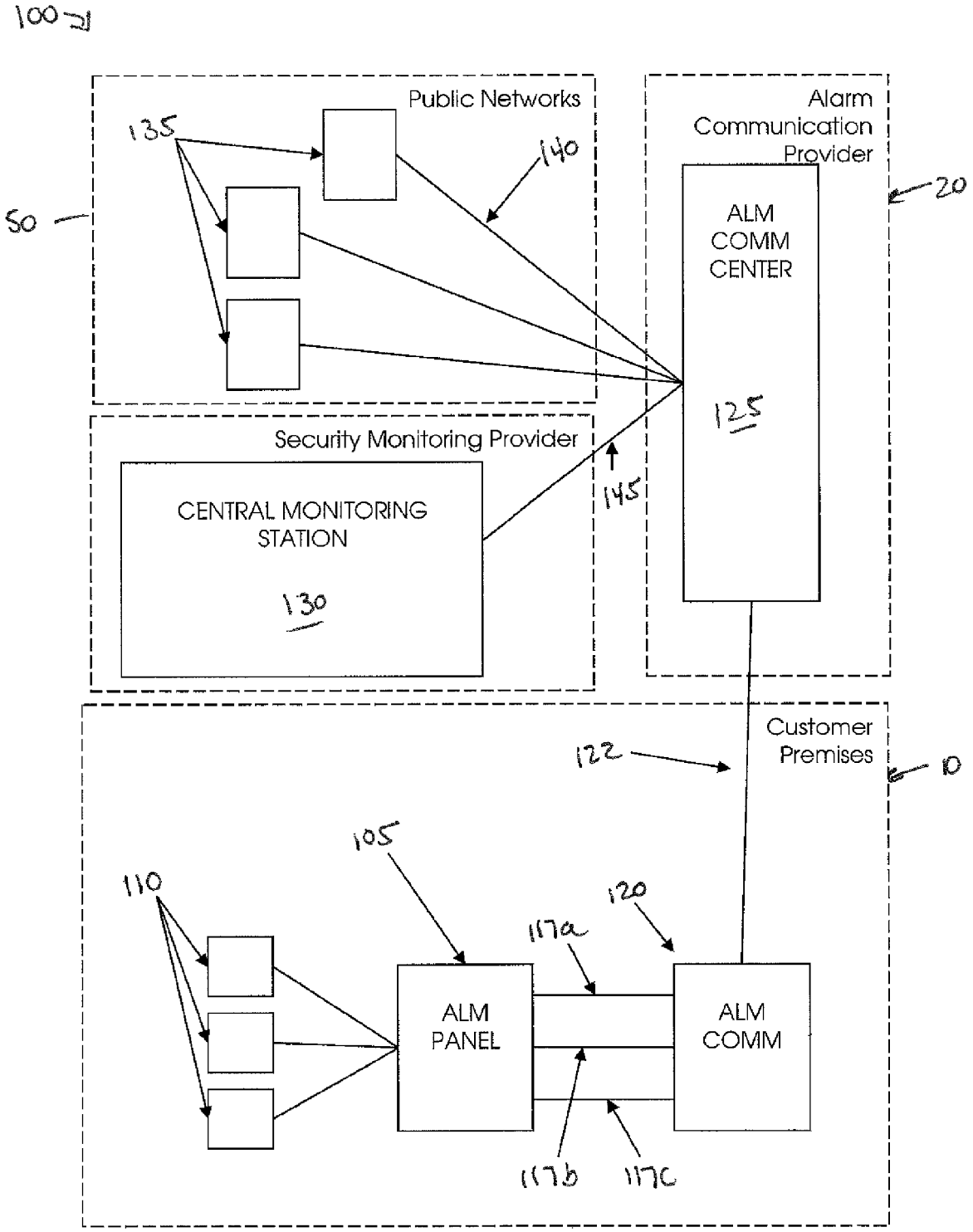
FIG. 1 is a schematic of the security system in accordance with an embodiment of the present invention.

While the invention is susceptible to embodiments in many different forms, there are shown in the drawings and will described herein, in detail, the preferred embodiments of the present invention. It should be understood, however, that the present disclosure is to be considered an exemplification of the principles of the invention and is not intended to limit the spirit or scope of the invention and the embodiments illustrated.

FIG. 1 illustrates an overview of a security system and the communication between the security system and the remote devices. It is important to note that while the concept of having an interactive control of an alarm panel is not new, the approach described herein is unique in that: (a) it is not integrated into the security system itself, which allows it to be added to almost any preexisting security system; (b) it makes use of standard interfaces available on almost any security system, which again makes it suitable for use with any security system; and (c) it provides a mechanism for confirming a change of status when a command is attempted. One or more of the present embodiments permit an alarm provider to offer basic notification and panel control to the subscriber or end user. This may include one or more of the following key components: (a) the ability for the subscriber to receive notifications of panel activity via SMS or email; (b) the ability for the subscriber to arm and disarm the alarm panel remotely, through a web portal, through SMS commands, and a mobile application; and/or (c) the ability for the subscriber's notifications and permissions to be configured through the web portal either by the subscriber or the dealer.

Still referring to FIG. 1, there is illustrated a security system 100 which includes a customer premises 10 in communication with an alarm communication provider 20. The alarm communication provider 20 communicates with both a security monitoring provider 30 and the user or subscriber 50.

The customer premises 10 includes an alarm panel 105 with a number of security sensors 110. Security sensors 110 detect intrusion, movement and other events and send notifications to the alarm panel 105. The security sensors 110 may be connected to the alarm panel through either wired or wireless connections. The alarm panel 105 collects events from the security sensors 110, and, depending on the status of the system, sends a notification to an alarm communicator 120. The status (armed or disarmed) of the alarm panel 105 can be controlled through one or more keypads, or a key-switch interface. The current status of the alarm panel 105 is indicted visually through the keypad, and it can also provide electrical outputs indicating its current status.

The alarm communicator 120 provides a communication path between the alarm panel 105 and the central monitoring station 130, by communicating with an alarm communication center 125 (discuss in greater detail below) for reporting events. The alarm communicator 120 also, provides local relays that will, upon command from the alarm communication center 125, open or close the circuit that controls the status of the alarm panel 105. In addition, the alarm communicator 120 monitors the open or closed state of the circuit(s) that comprises the status feedback interface, and provides status of the alarm panel 105 to the alarm communication center 125.

As illustrated in FIG. 1, there are multiple distinct interfaces that connect the alarm panel 105 to the alarm communicator 120. The interfaces can be classified as a reporting interface 117*a*, control interface 117*b*, and status feedback interface 117*c*. The reporting interface 117*a* is used by the alarm panel 105 to report events to the alarm communicator 120. Physically, it can either be a dial capture (telephone) connection, or a broadband interface such as Ethernet. It reports events in a particular format, e.g. Contact Id, which contains information about the event, as well as where and when it occurred.

The control interface 117*b* is used by the alarm communicator 120 to control the status of the alarm panel 105. It is an electrical interface that uses the opening and closing of a relay in the alarm communicator 120 to signal the alarm panel 105 to change its status. The connection on the alarm panel 105 for this interface is typically one designated for use with an alarm panel key-switch.

The status feedback interface 117*c* provides the alarm communicator 120 with an indication of the arming status of the panel 105 by opening or closing an electrical circuit. The alarm panel 105 may also provide an indication of the ready status (i.e. whether or not the panel is ready to be armed) by opening or closing another electrical circuit.

The interface 122 between the alarm communicator 120 and the alarm communication center 125 reports events detected by the alarm panel 105, and allows the alarm communication center 125 to control the status of the alarm panel 105 through the alarm communicator 120. It can be a wired or wireless interface, and may be one or more of cellular SMS, cellular IP, Ethernet, WiFi, or similar interfaces.

The alarm communication center 125 monitors the status of the alarm communicator, and the alarm panel to which it is connected. When an event report is received from the alarm communicator 120, it may forward that report to a central monitoring station 130, or notify remote device(s) 135 for subscriber(s), or neither, depending on the type of event and the filtering that is set up for that communicator. It also stores the received events for later retrieval. The Alarm Communication Center 125 also receives status change requests from the remote devices 135, and sends those requests in a form suitable for the alarm panel 105 to the alarm communicator 120. As defined herein a remote device 135 may be a mobile device or any other device (phone, computer, or otherwise) that is remote to the alarm panel, meaning not on the premises or located on the same premises to the alarm panel.

The type of notification 140 to the remote device(s) 135 may depend on the device. The notification 140 method may be any one or more of the following: email, SMS, voice dialing, pager, instant messaging, mobile device push notification, or any other automated notification method. Notifications can be sent to any number of devices, each of which can be an email account, a mobile SMS device, a mobile smartphone, a voice telephone, a pager, a web application, or a custom computer application. These devices may also send status change requests for the alarm panel to the alarm communication center.

The alarm communication center 125 sends event reports to the remote central monitoring station 130 via a standard interface 145. This standard interface may be either telephony-based, using phone calls in a manner similar to that used when alarm panels contact the central station directly, or they may be via an IP connection, which allows faster, more cost-effective communication with the central station. The central monitoring station 130 collects event reports from the alarm panel 105, which is connected through the alarm communicator 120 and the alarm communication center 125. When it receives an event report, it may automatically notify emergency personnel, or it may dispatch maintenance personnel, or it may forward the event to a human operator for confirmation.

Figure 2:
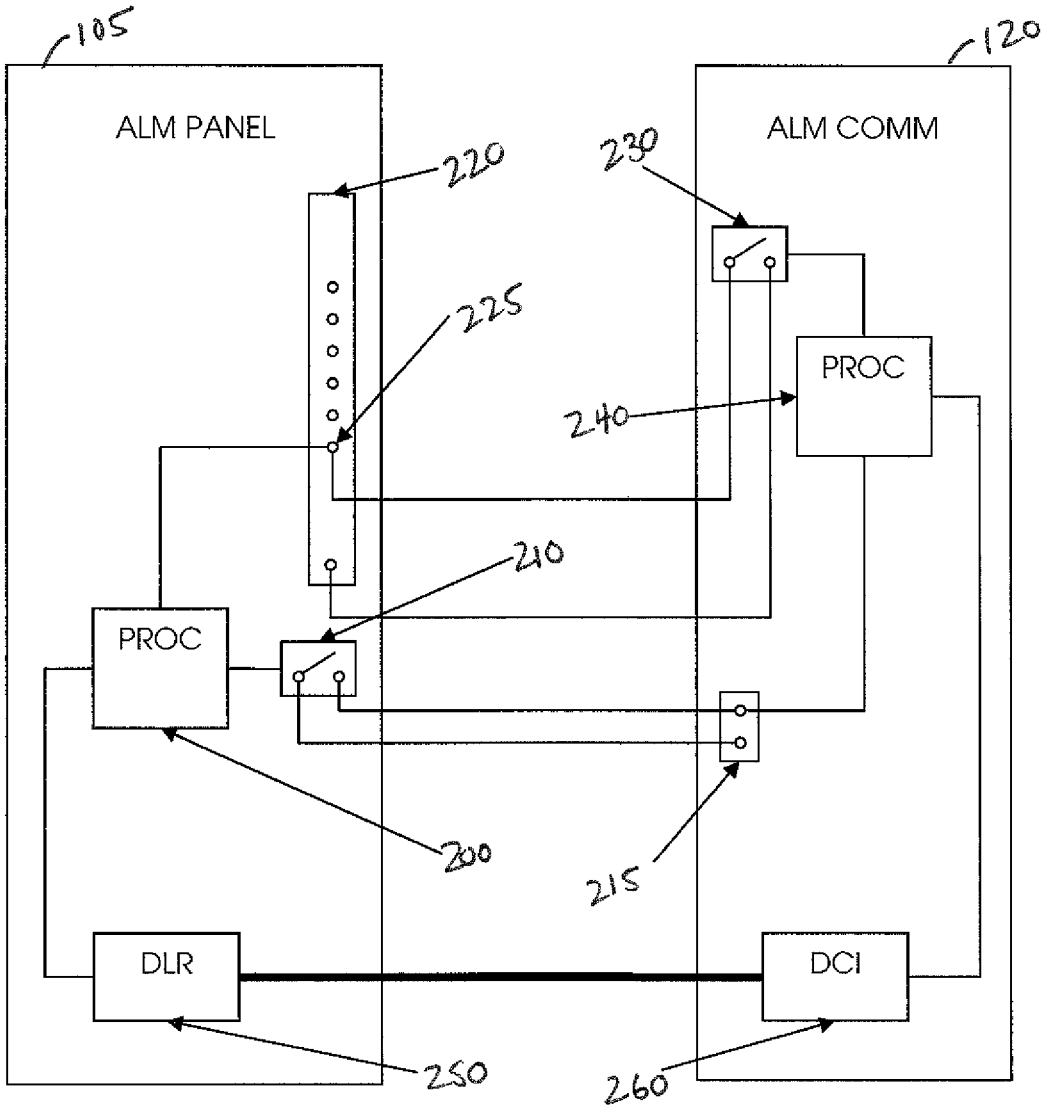
FIG. 2 is a schematic of the connection and communication between an alarm panel and alarm communicator in accordance with an embodiment of the present invention.

Referring now to FIG. 2, there is shown in greater detail the connections between an alarm panel 105 and the alarm communicator 120. The alarm panel 105 will contain various processors 200 and associated components for the alarm panel functionality, including a processor-controlled relay 210 that indicates the status of the alarm panel 105, and including a plurality of input terminals 220. The input terminals 220 are typically wired or wirelessly connected to sensors or sensor zones. In addition, the input terminals 220 include a key-switch terminal 225. While the other input terminals 220 may also be connected to the processor 200, the present illustrated simply shows the key-switch terminal 225 connected to the processor 200 for simplicity purposes only. The present invention, however, using the key-switch terminal 225 and connects its path directly to a processor-controlled relay 230 on the alarm communicator 120. The processor-controlled relay 230 is used to change the status of the alarm panel 105. When closed, the signal from the processor-controlled relay 230 on the alarm communicator 120 is sent to the key-switch terminal 225 indicating to the alarm panel 105 that the system should be armed. Therefore, the alarm panel 105 believes an actual key switch was turned, while in actuality the alarm communicator 120 simply closed a relay switch. As can be envisioned the opposite will occur with the processor-controlled relay 230 on the alarm communicator 120 is opened, signaling the alarm panel 105 to disarm.

The processor-controlled relay 230 on the alarm communicator 120 is controlled by a processor 240, which can receive instructions (including arming and disarming) from a remote 135 device through the alarm communication center 125.

The processor 240 in the alarm communicator 120 may further be connected to an input terminal 215 for detecting the current status of the alarm panel, received from the processor-controlled relay 210 of the alarm panel 105.

For completeness, the alarm panel 105 and the alarm communicator 120 include a digital dialer 250 and a dial capture interface 260 (respectively) which send/receive report events using an industry standard protocol.

Figure 3:
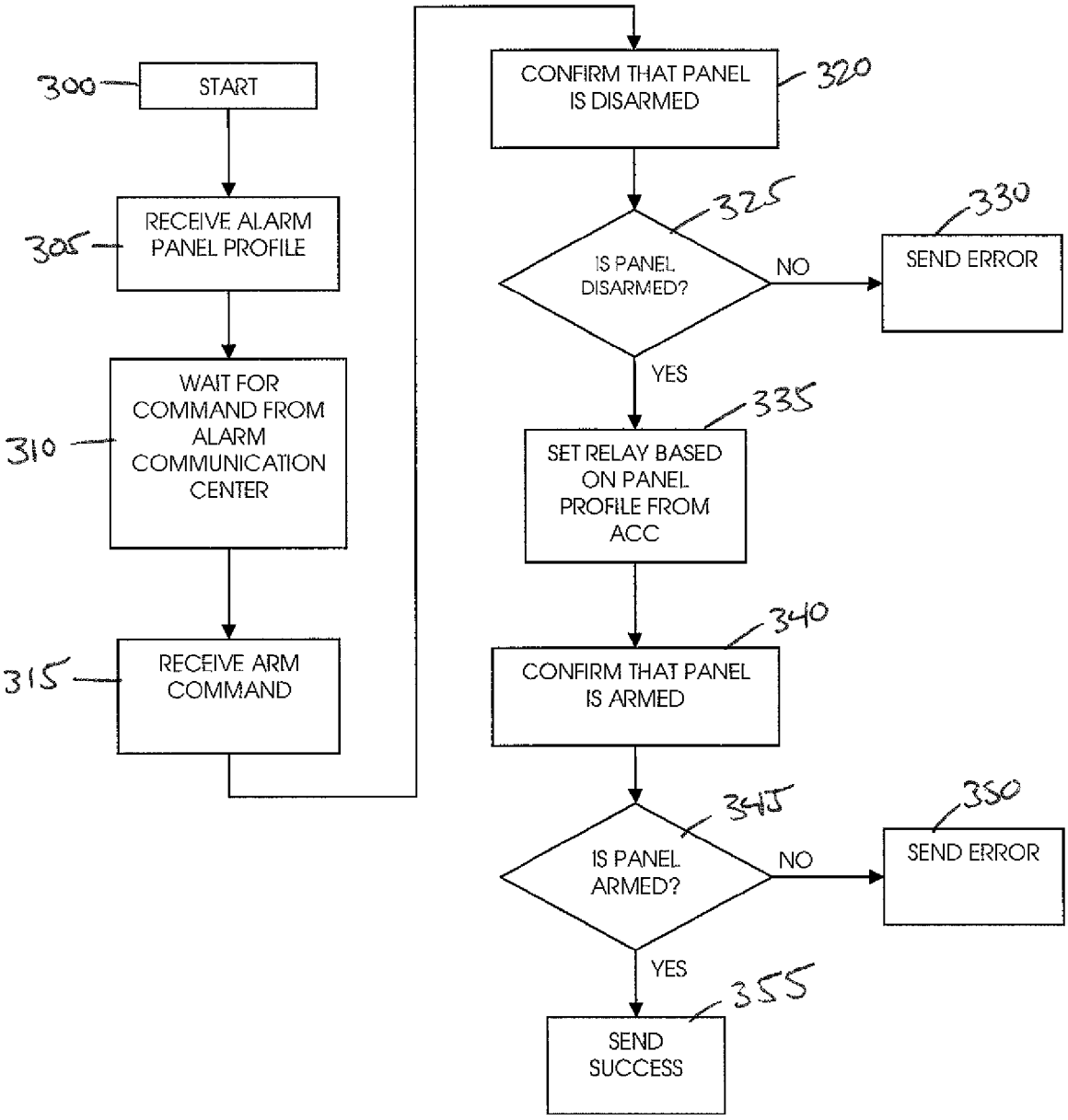
FIG. 3 is a method flowchart illustrating the arming of the alarm panel in accordance with one embodiment of the present invention.

Referring now to FIG. 3, there is provided a flowchart illustrating the system as the security system is remotely armed in accordance to one or more embodiments of the present invention. The method begins with the alarm communicator 120 at Box 300 and proceeds to where the alarm communicator 120 receives from the alarm panel 105 an alarm profile, Box 305. The alarm profile contains information on whether the feature is enabled and whether the control relay 230 should be normally open or normally closed. In one particular embodiment most of the alarm panel specifics are contained in the arm or disarm command. The profile is able to contain specific information on how to control the arming and disarming through the relay, along with what conditions on the input terminal constitute a success or failure. The elements in the embodiment that may be sent in the profile include: (a) Precondition on the input terminal for the arm operation (as a voltage range); (b) The start state of the relay; (c) The stop state of the relay; (d) The start interval for the relay; (e) The stop interval for the relay; (f) The repeat interval (the length of time that the start and stop operations are repeated); and/or (g) The delay needed before reading the input terminal.

The alarm communicator 120 waits to receive a command from the alarm communication center 125, box 310. The command to arm the alarm panel 105 is sent by a remote device 135 by a user to the alarm communication center 125 and then passed on to the alarm communicator 120, box 315. Once the arming command is received, the alarm communicator 120 confirms that the alarm panel 105 is disarmed, box 320. Box 325 checks whether the alarm panel 105 is disarmed; if it is not disarmed, the system sends an error message back to the alarm communication center 125, box 330, which indicates nothing further is needed to be done, since the system was already armed. If the alarm panel is disarmed, the method proceeds to box 335. At box 335, the method sets the processor-controlled relay 230 on the alarm communicator 120 to the closed position indicating through the key-switch interface to arm the alarm. The arm signal is passed to the processor 200 on the alarm panel and the processor-controlled relay 210 of the alarm panel 105 is closed such that the alarm communicator 120 can confirm the arming of the alarm panel 105, box 340. In box 345 the alarm communicator 120 confirms whether the alarm panel 105 is armed, if it is not armed then an error is sent to the alarm communication center 125, box 350. If the system is armed, box 355, the alarm communicator 120 sends a success signal to the alarm communication center 120, which may forward the same to the remote device 135 to provide confirmation that the system was armed as instructed.

Figure 4:
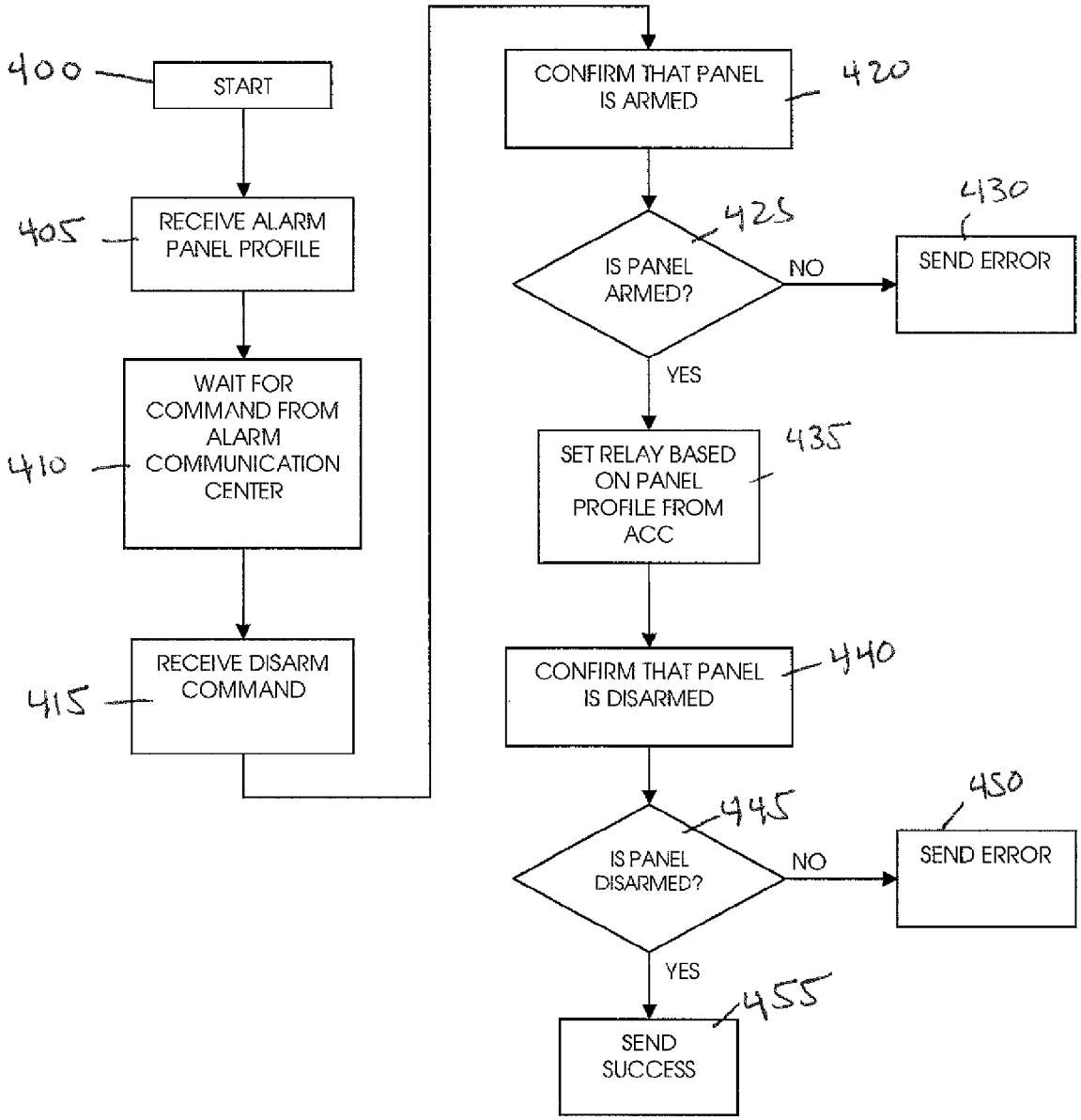
FIG. 4 is a method flowchart illustrating the disarming of the alarm panel in accordance with one embodiment of the present invention.

Referring now to FIG. 4, there is provided a flowchart illustrating the system as the security system is remotely disarmed in accordance to one or more embodiments of the present invention. The method begins with the alarm communicator 120 at Box 400 and proceeds to where the alarm communicator 120 receives from the alarm panel 105 the alarm profile, Box 405. The alarm communicator 120 waits to receive a command from the alarm communication center 125, box 410. The command to disarm the alarm panel 105 is sent by a remote device 135 by a user to the alarm communication center 125 and then passed on to the alarm communicator 120, box 415. Once the disarming command is received, the alarm communicator 120 must confirm that the alarm panel 105 is armed, box 420. Box 425 checks whether the alarm panel 105 is armed; if it is not armed, the system sends an error message back to the alarm communication center 125, box 430, which indicates nothing further is needed to be done, since the system was already disarmed. If the alarm panel is armed, the method proceeds to box 435. At box 435, the method sets the processor-controlled relay 230 on the alarm communicator 120 to the opened position to indicate through the key-switch interface that the alarm is disarmed. The disarm signal is passed to the processor 200 on the alarm panel and the processor-controlled relay 210 of the alarm panel 105 is opened such that the alarm communicator 120 is able to confirm the disarming of the alarm panel 105, box 440. In box 445 the alarm communicator 120 confirms whether the alarm panel 105 is disarmed, if it is not than an error is sent to the alarm communication center 125, box 450. If the system is disarmed, box 455, the alarm communicator 120 sends a success signal to the alarm communication center 120, which may forward the same to the remote device to confirm that the system was disarmed as instructed.

As described above, one or more embodiment of the present invention provide for different aspects used either separately or together in concert. First, the use of a key-switch input on the alarm panel configured for use by the alarm communicator to remotely control the armed/disarmed status of the alarm panel. Since previous implementations of this functionality utilized a proprietary interface to communicate the status, it is believed the present approach is more universal across multiple different types of alarm panels.

Second, a dial capture interface between the alarm panel and the alarm communicator is used with a telephony interface. This receives event notification from the alarm panel. The alarm communicator and alarm communication center use these event notifications to learn additional details about changes in status of the alarm panel. The dial capture interface may also be used in addition to, or in lieu of, the input relay on the alarm communicator to confirm the change in status of the alarm panel when a remote arm or remote disarm is processed.

Third, confirmation of a change in status on the alarm panel. After setting the relay to effect a change in status for the alarm panel, the alarm communicator confirms the status change. This is done by: (a) checking the status of the status input that is connected to the processor-controlled relay on the alarm panel, (b) interpreting the received event notifications on the dial capture interface to confirm that the status has changed, or (c) a combination of both of the above.

Lastly, the use of a "ready" status. In addition to using the armed/disarmed input from the alarm panel, the alarm communicator may also be connected to the "ready to arm" processor-controlled relay on the alarm panel, if one is available.

This provides additional input to the alarm communication center on the current status of the alarm panel.

The present invention includes various embodiments, as provided by the claims of the invention, the first embodiment is provided by comprising an alarm system having an alarm panel and an alarm communicator. The alarm panel includes a key-switch input terminal, and the alarm communicator includes a processor and a relay switch. The relay switch is connected or configured to communicate directly with the key-switch input terminal such that when the relay switch is in an open or closed position a signal is sent to the key-switch input terminal to disarm or arm the alarm system. The relay switch is further controlled by the processor to move to the open or closed position. The system further includes a signal receiver in communication with the processor and a control signal, specifically created from a command sent from a remote device, that is received by the signal receiver. Once received the signal receiver prompts the processor to control the relay switch such that the alarm system disarms or arms.

It may also be conceived that the control signal is created from and/or based upon a command sent from a remote device. The control signal may be an email, SMS, voice dialing instructions, pager notification, instant message notice, or mobile device push notification.

The first embodiment may also further include an alarm communication provider adapted to send and receive signals to the alarm communicator and adapted to send and receive signals from a remote device. The alarm communication provider upon receiving a command from the remote device to arm or disarm the alarm system is capable of creating the control signal and sending the control signal to the alarm communicator.

In a second embodiment there is provided an alarm system also having an alarm panel and an alarm communicator. The alarm panel has a key-switch input terminal, and the alarm communicator has a relay switch configured to communicate directly with the key-switch input terminal. The relay switch is adapted to send open or close signals to the key-switch input terminal to disarm or arm the alarm system. The alarm communicator further has a signal receiver to receive a control signal created from a command sent from a remote device instructing the alarm communicator to open or close the relay switch such that the alarm system disarms or arms.

In a third embodiment, the present invention includes an alarm system including an alarm panel; the alarm panel has a key-switch input terminal. The system is improved by having an alarm communicator having a relay switch configured to communicate directly with the key-switch input terminal. When the alarm communicator receives a control signal created from a command based from a remote device, the alarm communicator is able to arm/disarm the alarm system by opening/closing the relay switch.

In a fourth embodiment, the present invention is directed to an alarm communicator configured to communicate directly with an alarm panel that has a key-switch input terminal. The alarm communicator in this embodiment includes a relay switch in communication with the key-switch input terminal. The relay switch is adapted to send open or closed signals to the key-switch input terminal to disarm or arm the alarm panel. In addition thereto, the alarm communicator further has a signal receiver to receive a control signal instructing the alarm communicator to open or close the relay switch such that the alarm panel disarms or arms.

In a fifth embodiment, the present invention provides a method for arming/disarming an alarm system from a remote device. The alarm system has an alarm panel defined to arm/disarm the alarm system and has at least a key-switch input terminal. The method has the following steps. First, providing an alarm communicator with a relay switch and connecting the relay switch to the key-switch input terminal, such that when the relay switch opens or closes, a signal is sent to the key-switch input terminal to disarm or arm the alarm system. Second, sending a command for the arming/disarming of the alarm system to the alarm communicator, wherein the command is based from instructions by a remote device. Third, setting the relay switch to open or close in accordance with the command based from the remote device. In addition, the method may further include providing an alarm communication for receiving and sending signals to and from the alarm communicator and to and from the remote device, and when upon receiving a command based from the remote device to arm or disarm the alarm system, creating and sending a control signal to the alarm communicator to open or close the relay switch.

In addition, the method may include the step of confirming a change in the status of the alarm system after the relay switch is set by the alarm communicator. And wherein the step of confirming the change in the status of the alarm system includes receiving by the alarm communicator a notification from a digital dialer defined on the alarm panel.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

I claim:

1. An alarm system comprising:

an alarm panel having a key-switch input terminal; and an alarm communicator having a processor and a relay switch, and further having a wire connector configured to connect the relay switch to the key-switch input terminal on the alarm panel such that when the relay switch is in an open or closed position a signal is sent to the key-switch input terminal to disarm or arm the alarm system, the relay switch being controlled by the processor to move to the open or closed position;

a signal receiver in communication with the processor; and a control signal, specifically created from a command sent from a remote device, being received by the signal receiver is capable of prompting the processor to control the relay switch such that the alarm system disarms or arms.

2. The alarm system of claim 1, wherein the control signal is one selected from the group of an email, SMS, voice dialing instructions, pager notification, instant message notice, or mobile device push notification.

3. The system of claim 1 further comprising:

an alarm communication provider adapted to send and receive signals to the alarm communicator and adapted to send and receive signals from the remote device, whereby the alarm communication provider upon receiving the command from the remote device to arm or disarm the alarm system creates the control signal and sends the control signal to the alarm communicator.

4. An alarm system comprising:

an alarm panel having a key-switch input terminal; and an alarm communicator defined for communicating alarm signals from the alarm panel to a central monitoring station, the alarm communicator further having a relay switch configured to communicate directly with the key-switch input terminal, the relay switch adapted to send open or close signals to the key-switch input terminal to disarm or arm the alarm system.

5. The system of claim 4, wherein the alarm communicator further having a signal receiver to receive a control signal instructing the alarm communicator to open or close the relay switch such that the alarm system disarms or arms.

6. The alarm system of claim 5, wherein the control signal is created from a command sent from a remote device.

7. The alarm system of claim 6, wherein the control signal is one selected from the group of an email, SMS, voice dialing instructions, pager notification, instant message notice, or mobile device push notification.

8. The system of claim 6 further comprising:

an alarm communication provider adapted to send and receive signals to the alarm communicator and adapted to send and receive signals from a remote device, whereby the alarm communication provider upon receiving a command from the remote device to arm or disarm the alarm system creates the control signal and sends the control signal to the alarm communicator.

9. An alarm system including an alarm panel, the alarm panel having a key-switch input terminal, the system further comprising:

an alarm communicator having a relay switch configured to communicate directly with the key-switch input terminal to arm/disarm the alarm system by opening/closing the relay switch, when the alarm communicator receives a control signal created from a command based from a remote device.

10. The system of claim 9, wherein the alarm communicator further includes a processor to control the opening/closing of the relay switch and the alarm communicator further including a signal receiver in communication with the processor, wherein when the signal receiver receives the control signal the processor controls the relay switch such that the alarm system disarms/arms.

11. An alarm communicator configured to communicate directly with an alarm panel, the alarm panel having a key-switch input terminal, the alarm communicator comprising:

an alarm communicator having a processor and a relay switch, a connection configured to connect the relay switch to the key-switch input terminal on the alarm panel such that when the relay switch is in an open or dosed position a signal is sent, through the connection, to the key-switch input terminal to disarm or arm the alarm system, the relay switch being controlled by the processor to move to the open or closed position;

a signal receiver in communication with the processor; and a control signal, specifically created from a command sent from a remote device, being received by the signal receiver is capable of prompting the processor to control the relay switch such that the alarm system disarms or arms.

12. A method for arming/disarming an alarm system from a remote device, the alarm system having an alarm panel defined to arm/disarm the alarm system and having at least a key-switch input terminal, the method comprising:

providing an alarm communicator with a relay switch and connecting the relay switch to the key-switch input terminal with a hard-wire connection, such that when the relay switch opens or closes, a signal is sent to the key-switch input terminal to arm or disarm the alarm system;

sending a command from a remote device for the arming/disarming of the alarm system to the alarm communicator; and setting the relay switch to open or dose based on the command from the remote device.

13. The method of claim 12 further comprising the steps of:

providing an alarm communication provider for receiving and sending signals to and from the alarm communicator and to and from the remote device, and when upon receiving a command from the remote device to array or disarm the alarm system, creating and sending a control signal to the alarm communicator to open or close the relay switch.

14. The method of claim 12 further comprising the steps of:

confirming a change in the status of the alarm system after the relay switch is set by the alarm communicator.

15. The method of claim 14, wherein the step of confirming the change in the status of the alarm system includes receiving by the alarm communicator a notification from a digital dialer defined on the alarm panel.

16. The method of claim 15 further includes the step of providing a dial capture interface in the alarm communicator for the receipt of the notification from the digital dialer.

* * * * *

UNITED STATES PATENT AND TRADEMARK OFFICE

CERTIFICATE OF CORRECTION

PATENT NO. : 8,854,187 B2
APPLICATION NO. : 12/882426
DATED : October 7, 2014
INVENTOR(S) : Gilson O. Motta It is certified that error appears in the above-identified patent and that said Letters Patent is hereby corrected as shown below:

In the Claims,

In Column 8, Line 53 in Claim 3, after "3. The" insert --alarm--, therefor.
In Column 9, Line 3 in Claim 5, after "5. The" insert --alarm--, therefor.
In Column 9, Line 13 in Claim 8, after "8. The" insert --alarm--, therefor.
In Column 10, Line 30 in Claim 13, delete "array" and insert --arm--, therefor.

Signed and Sealed this
Third Day of February, 2015

Michelle K. Lee

Michelle K. Lee
*Deputy Director of the United States Patent and Trademark Office*